US008419485B2

(12) United States Patent
Stausser et al.

(10) Patent No.: US 8,419,485 B2
(45) Date of Patent: Apr. 16, 2013

(54) BULKHEAD CONNECTOR ASSEMBLY

(75) Inventors: David Charles Stausser, Winston-Salem, NC (US); David Allen Klein, Kernersville, NC (US); John Raymond Shuey, Mechanicsburg, PA (US); Joel Daniel Sandburg, Winston-Salem, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/206,349

(22) Filed: Aug. 9, 2011

(65) Prior Publication Data

US 2012/0196465 A1 Aug. 2, 2012

Related U.S. Application Data

(60) Provisional application No. 61/462,034, filed on Jan. 27, 2011.

(51) Int. Cl.
*H01R 13/514* (2006.01)

(52) U.S. Cl.
USPC ..... 439/752; 439/595; 439/559

(58) Field of Classification Search ..... 439/752, 439/595, 559
See application file for complete search history.

(56) References Cited

U.S. PATENT DOCUMENTS

| | | | | |
|---|---|---|---|---|
| 5,928,038 | A * | 7/1999 | Berg et al. | 439/752 |
| 6,093,063 | A * | 7/2000 | Tsuji et al. | 439/752 |
| 6,358,102 | B1 * | 3/2002 | Fukamachi | 439/752 |
| 6,361,378 | B1 * | 3/2002 | Konoya et al. | 439/752 |
| 6,638,109 | B2 * | 10/2003 | Kurimoto et al. | 439/595 |

OTHER PUBLICATIONS

Terminal Hole Position; Tyco Electronics, May 9, 2011, 3 pgs.

* cited by examiner

*Primary Examiner* — Ross Gushi

(57) ABSTRACT

A bulkhead connector assembly is provided having an outer housing that has an internal chamber. The outer housing has a sealing section configured to seal an exterior of the outer housing within an opening. A terminal housing is configured to hold a plurality of terminals. The terminal housing is received in the internal chamber. The terminal housing has primary locking mechanisms configured to secure the terminals in the terminal housing. An independent secondary lock (ISL) is separately provided from, and coupled to, the terminal housing. The ISL is configured to secure the terminals in the terminal housing and assure they are properly seated.

18 Claims, 6 Drawing Sheets

BULKHEAD CONNECTOR ASSEMBLY

CROSS REFERENCE TO RELATED APPLICATIONS

This application claims the benefit of U.S. Provisional Application No. 61/462,034 filed Jan. 27, 2011, the subject matter of which is herein incorporated by reference in its entirety.

BACKGROUND OF THE INVENTION

The subject matter herein relates generally to sealed bulkhead connector assemblies.

Automatic transmissions in some automobiles may include a transmission case that has wires extending from the case or a connector joined to the case. The wires may be coupled with other components or the connector may be joined with another connector in the automobile to transfer power and signal to and from the transmission. These inputs may be used to shift or change gears in the transmission, or operate a pump of the transmission, for example.

The wires or connectors exit from the transmission case from openings in the case. These openings may need to be sealed in order to prevent contaminants from outside of the transmission case, such as moisture, dirt, and the like, from entering into the transmission case via the openings. Additionally, the openings may need to be sealed to prevent contaminants inside the transmission case, such as transmission fluid, from exiting the transmission case via the openings.

Additionally, the cavity for the terminal within the connector must be sealed from contaminants. In current applications, a seal is provided at the terminal entry side, either with a mat type seal or individual wire seals that are crimped to the terminal. These types of seals are typically made from silicone which is not compatible with all automatic transmission fluids (ATF). Additionally, both of these seal types squeeze the outside of the wire insulation to provide sealing. This would require the use of fluid blocked (anti-capillary) wire to prevent fluid from wicking under the insulation and past the seal.

Along with proper sealing, the terminals must be completely inserted into the connectors to provide a complete electrical connection. In some current designs, the connector may be assembled with the terminals not positioned correctly or completely seated within the connector. A terminal position assurance feature is required to assure the correct position of the terminal. In addition to checking for partially installed terminals, a Terminal Position Assurance (TPA) feature such as an Independent Secondary Lock (ISL) will also provide enhanced terminal retention force when properly seated.

Oil or fluid blocking connector designs today are not well featured to assure proper connector assembly and sealing. Some "state of the art" systems offer a Terminal Position Assurance (TPA) device, but these are only Primary Latch Reinforcing (PLR) designs and do not offer an Independent Secondary Lock (ISL) which provides terminal retention even if the primary latch were to fail. In addition, previous designs having a front loaded TPA are often potted with sealant behind the TPA which is risk prone due to the need to having the sealant flow around various irregularly shaped components while not having it escape through to the point of creating a leak path through to the other side. With that approach, it is difficult to assure proper sealant dispensing in all areas since the sealant cannot be seen visually in all areas behind the TPA.

Other sealing approaches are used in industry as well such as using fluid blocking wire which contains silicone as a blocking material within the wire strands. It is expensive, stiff to the point of causing risk for terminal crimp failures, and for automatic transmission applications the use of silicone in the fluid area is a problem due to material breakdown.

A need exists for a bulkhead connector that solves these problems.

BRIEF DESCRIPTION OF THE INVENTION

In one embodiment, a bulkhead connector assembly is provided having an outer housing that has an internal chamber. The outer housing has a sealing section configured to seal an exterior of the outer housing within an opening. A terminal housing is configured to hold a plurality of terminals. The terminal housing is received in the internal chamber. The terminal housing has primary locking mechanisms configured to secure the terminals in the terminal housing. An independent secondary lock (ISL) is separately provided from, and coupled to, the terminal housing. The ISL is configured to secure the terminals in the terminal housing.

In another embodiment, a bulkhead connector assembly is provided having an outer housing that has an internal chamber. The outer housing has a mating end and a wire end. The outer housing has a sealing section between the mating and wire ends. The sealing section is configured to seal an exterior of the outer housing within an opening. An insert subassembly is configured to be received in the internal chamber. The insert subassembly includes a terminal housing and an independent secondary lock (ISL) separately provided from, and coupled to, the terminal housing. The terminal housing is configured to hold a plurality of terminals. The terminal housing has primary locking mechanisms that are configured to secure the terminals in the terminal housing. The ISL is configured to independently secure the terminals in the terminal housing. The ISL is movable with respect to the terminal housing between a clearance position and a blocking position. The ISL allows the terminals to be loaded into the terminal housing in the clearance position. The ISL is configured to back up the terminals and prevent terminal extraction in the blocking position. The insert subassembly is able to be coupled to the outer housing in a terminal loading position and a locked position. The insert subassembly is loaded into the wire end of the outer housing to the terminal loading position and is further loaded into the internal chamber to the locked position only after the ISL is moved to the blocking position.

In a further embodiment, a bulkhead connector assembly is provided having an outer housing that has an internal chamber. The outer housing has an interior wall that separates the internal chamber into a mating side and a wire side. The interior wall has a plurality of cavities therethrough that are configured to receive terminals therethrough such that the terminals are located in both the mating side and wire side of the internal chamber. The interior wall defines a sealant blocking floor for the mating side of the internal chamber. The outer housing has a sealing section that is configured to seal an exterior of the outer housing within an opening. A terminal housing is configured to hold a plurality of terminals. The terminal housing is received in the internal chamber. The terminal housing has primary locking mechanisms that are configured to secure the terminals in the terminal housing. An independent secondary lock (ISL) is separately provided from, and coupled to, the terminal housing. The ISL is configured to secure the terminals in the terminal housing. A sealant at the sealant blocking floor is configured to seal the terminals at the cavities.

DETAILED DESCRIPTION OF THE INVENTION

Figure 1:
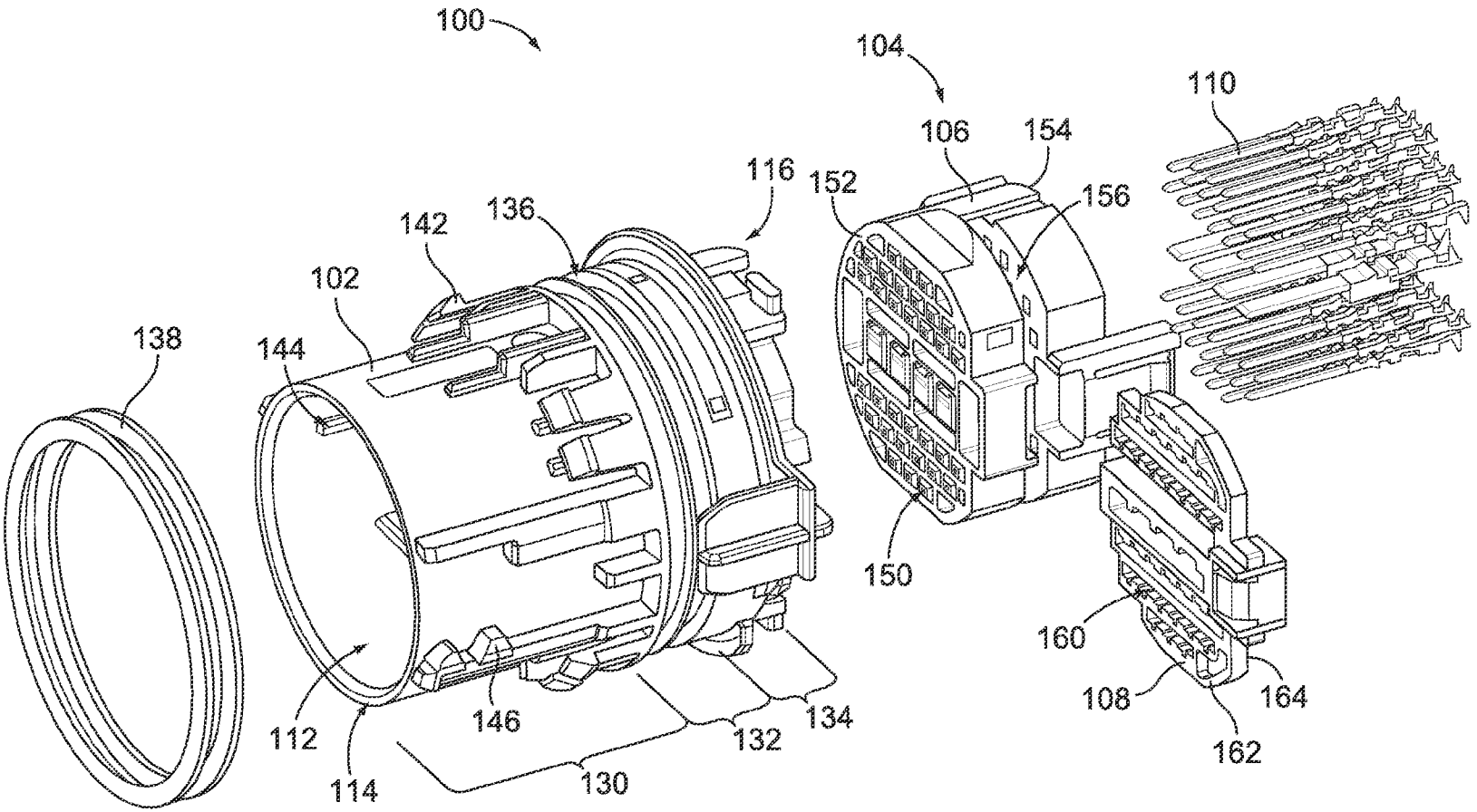
FIG. 1 is an exploded view of a bulkhead connector assembly formed in accordance in an exemplary embodiment.

FIG. 1 is an exploded view of a bulkhead connector assembly 100 formed in accordance in an exemplary embodiment. The bulkhead connector assembly 100 includes an outer housing 102 and an insert subassembly 104 configured to be loaded into the outer housing 102. The insert subassembly 104 includes a terminal housing 106 and an independent secondary lock (ISL) 108. The terminal housing 106 is configured to hold a plurality of terminals 110 in the outer housing 102. In an exemplary embodiment, the bulkhead connector assembly 100 defines a fluid blocking connector assembly for use in an application requiring a sealed electrical connection.

Figure 4:
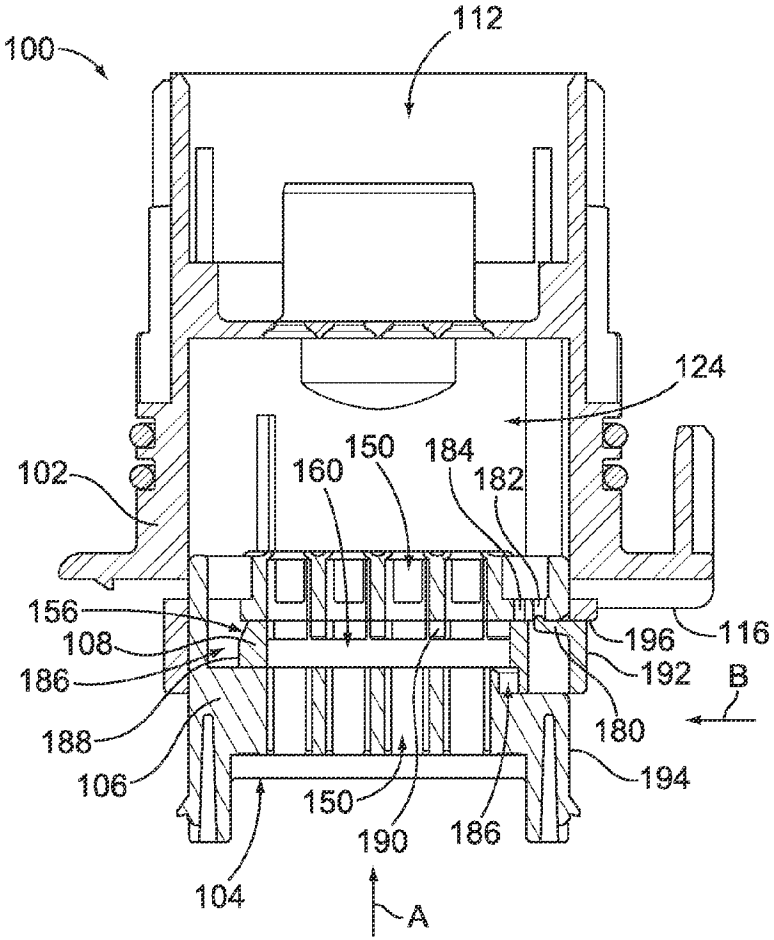
FIG. 4 is a cross-sectional view of the bulkhead connector assembly showing the insert subassembly coupled to the outer housing.

The outer housing 102 includes an internal chamber 112 that receives the insert subassembly 104 and terminals 110 from the wire side 124 (shown in FIG. 4). The outer housing 102 has a mating end 114 and a wire end 116. The mating end 114 is configured to be mated with a mating connector 118 (shown in FIG. 8). Wires extending from the terminals 110 extend from the wire end 116.

The outer housing 102 includes a mating section 130, a sealing section 132 and a flange section 134. The mating section 130 is located proximate to the mating end 114. The flange section 134 is located proximate to the wire end 116. The sealing section 132 is positioned between the mating section 130 and the flange section 134. The outer housing 102 includes one or more grooves 136 in the sealing section 132. O-rings 138 are configured to be set into corresponding grooves 136 to seal the outer surface of the bulkhead connector assembly 100 with a bulkhead or panel 140 (shown in FIG. 9) to prevent any contaminants from passing around the bulkhead connector assembly 100. The sealing section 132 is configured to seal an exterior of the outer housing 102 within an opening 230 (shown in FIG. 8) of the bulkhead or panel 140.

The outer housing 102 includes mounting latches 142 proximate to the mating section 130 and/or the sealing section 132. The mounting latches 142 are configured to engage the panel 140 to secure the bulkhead connector assembly 100 to the panel 140. In an exemplary embodiment, the mounting latches 142 are deflectable latches having shoulders that engage the panel 140 to secure the bulkhead connector assembly 100 to the panel 140. Other types of mounting latches or mounting features may be provided in alternative embodiments to secure the bulkhead connector assembly 100 to the panel 140.

The outer housing 102 includes one or more keying members 144 at the mating section 130. The keying members 144 align with a corresponding keying member on the mating connector 118 to orient the mating connector 118 with respect to the bulkhead connector assembly 100. In the illustrated embodiment, the keying members 144 are projections or keys extending from the inside surface of the outer housing 102. The position, size and/or shape of the keying members 144 may be changed to define different mating interfaces for keyed mating with corresponding mating connectors 118. Other types of keying members may be used in alternative embodiments.

The outer housing 102 includes mating latches 146 extending from the outer surface of the outer housing 102. In the exemplary embodiment, the mating latches are gear teeth however other latching configurations would be suitable. The mating latches 146 are engaged by the mating connector 118 to secure the mating connector 118 to the bulkhead connector assembly 100. In the illustrated embodiment, the mating latches 146 include projections or shoulders that are engaged by a corresponding lever of the mating connector 118 to secure the mating connector 118 to the bulkhead connector assembly 100. Other types of mating mechanical assist features instead of gear teeth may be used in alternative embodiments, to secure the mating connector 118 to the bulkhead connector assembly 100.

The terminal housing 106 is sized and shaped to fit in the internal chamber 112. The terminal housing 106 includes a plurality of cavities 150 that receive corresponding terminals 110. The terminal housing 106 includes a front surface 152 and a rear surface 154 generally opposite the front surface 152. The terminal housing 106 extends axially between the front surface 152 and the rear surface 154. The cavities 150 extend entirely through the terminal housing 106 between the front surface 152 and the rear surface 154.

The terminal housing 106 includes a slot 156 positioned axially between the front surface 152 and the rear surface 154. Optionally, the slot 156 may be approximately centered between the front surface 152 and the rear surface 154. The ISL 108 is configured to be loaded into the slot 156. In an exemplary embodiment, the ISL 108 is radially inserted into the terminal housing 106 by way of the slot 156.

In an exemplary embodiment, as described in further detail below, the ISL 108 may be variably positionable within the terminal housing 106. For example, the ISL 108 may be positionable at a clearance position and at a blocking position. The ISL 108 allows the terminals 110 to be loaded into the terminal housing 106 in the clearance position. The ISL 108 is configured to block the terminals 110 from removal from the terminal housing 106 in the blocking position. The ISL 108 operates as a secondary lock to block the terminals 110 from removal from the terminal housing 106 as well as assuring properly seated terminals 110.

The ISL 108 includes a plurality of cavities 160 that are configured to receive the terminals 110 therein. In the clearance position, the cavities 160 of the ISL 108 are configured to be aligned with the cavities 150 of the terminal housing 106. The ISL 108 includes a front surface 162 and a rear surface 164 generally opposite the front surface 162. The slot 156 may be sized to receive the ISL 108 without allowing substantial axial movement of the ISL 108 within the slot 156. When the ISL 108 is received in the slot 156, the terminal housing 106 blocks axial movement of the ISL 108 with respect to the terminal housing 106.

Figure 2:
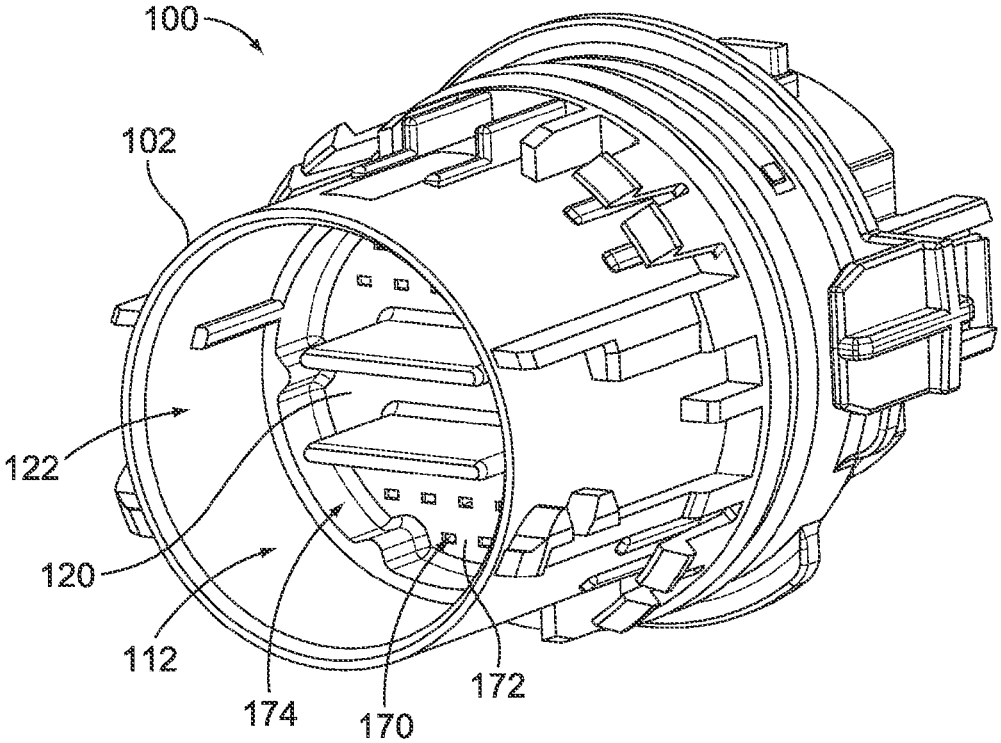
FIG. 2 is a front perspective view of the bulkhead connector assembly shown in FIG. 1.

FIG. 2 is a front perspective view of the bulkhead connector assembly 100. The outer housing 102 includes an interior wall 120 separating the internal chamber 112 into a mating side 122 and a wire side 124 (shown in FIG. 4). The interior wall 120 includes a plurality of cavities 170 therethrough that are configured to receive corresponding terminals 110 (shown in FIG. 1) therethrough such that the terminals 110 are located in both the mating side 122 and the wire side 124 (shown in FIG. 4).

The interior wall 120 defines a sealant blocking floor 172 for the mating side 122 of the internal chamber 112. A sealant well 174 is defined forward of the sealant blocking floor 172. The sealant well 174 is configured to be at least partially filled with sealant after the terminals 110 are loaded into the bulkhead connector assembly 100. The sealant seals the terminals 110 at the cavities 170 to prevent any contaminants such as oil or fluid to pass between the mating side 112 and the wire side 124 of the internal chamber 112 of the outer housing 102.

Figure 3:
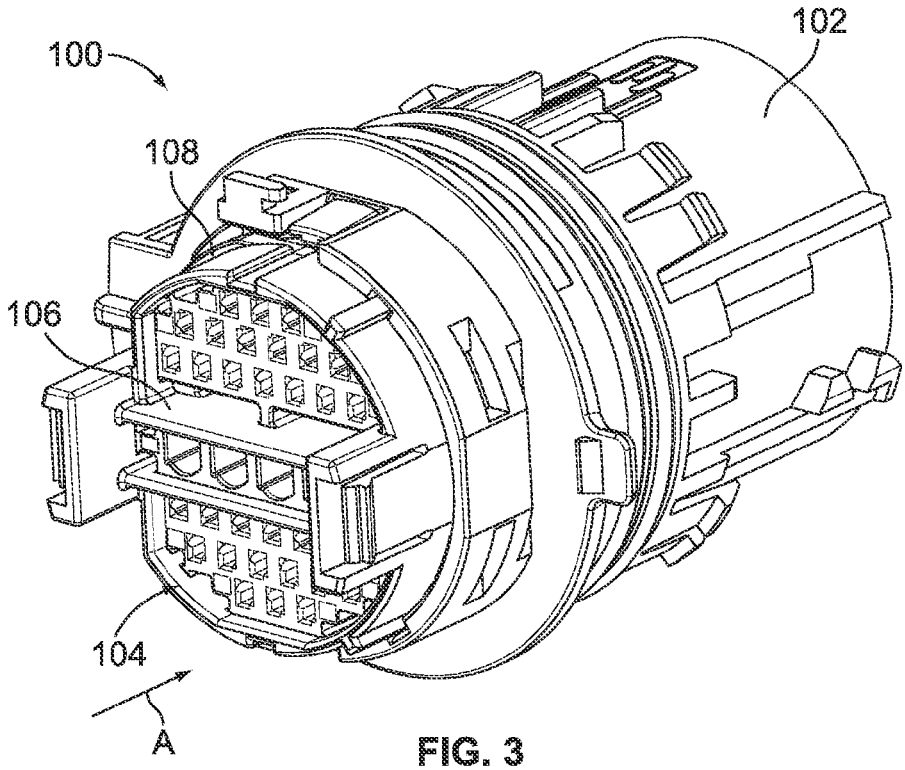
FIG. 3 is a rear perspective view of the bulkhead connector assembly with an insert subassembly partially inserted into an outer housing.

FIG. 3 is a rear perspective view of the bulkhead connector assembly 100 with the insert subassembly 104 partially inserted into the outer housing 102 in a terminal loading position. The bulkhead connector assembly 100 may be sold and shipped with the insert subassembly 104 in the terminal loading position. When in the partially inserted terminal loading position, the insert subassembly 104 allows the bulkhead connector assembly 100 to be shipped as one unit avoiding the complications of shipping two separate units. With the insert subassembly 104 in the terminal loading position, solid (without seals to allow sealant leakage) terminals 110 (shown in FIG. 1) previously crimped onto unblocked wire are installed into the terminal housing 106 of the insert subassembly 104.

When all of the terminals 110 are in place, the ISL 108 may be moved from the clearance position to the blocking position to lock the terminals 110 (shown in FIG. 1) in the terminal housing 106. Once the ISL 108 is in the blocking position, the insert subassembly 104 may be further loaded into the outer housing 102, such as in the direction of arrow A, to a locked position. In an exemplary embodiment, to ensure that all terminals 110 are properly loaded into the terminal housing 106 prior to locking the insert subassembly 104 into the outer housing 102, the insert subassembly 104 may only be loaded into the wire side 124 of the internal chamber 112 (shown in FIG. 4) to the locked position only after the ISL 108 is moved to the blocking position. The ISL 108 can only be moved to the blocking position when all of the terminals 110 are fully loaded into the terminal housing 106. The ISL 108 operates as a terminal position assurance device.

Figure 5:
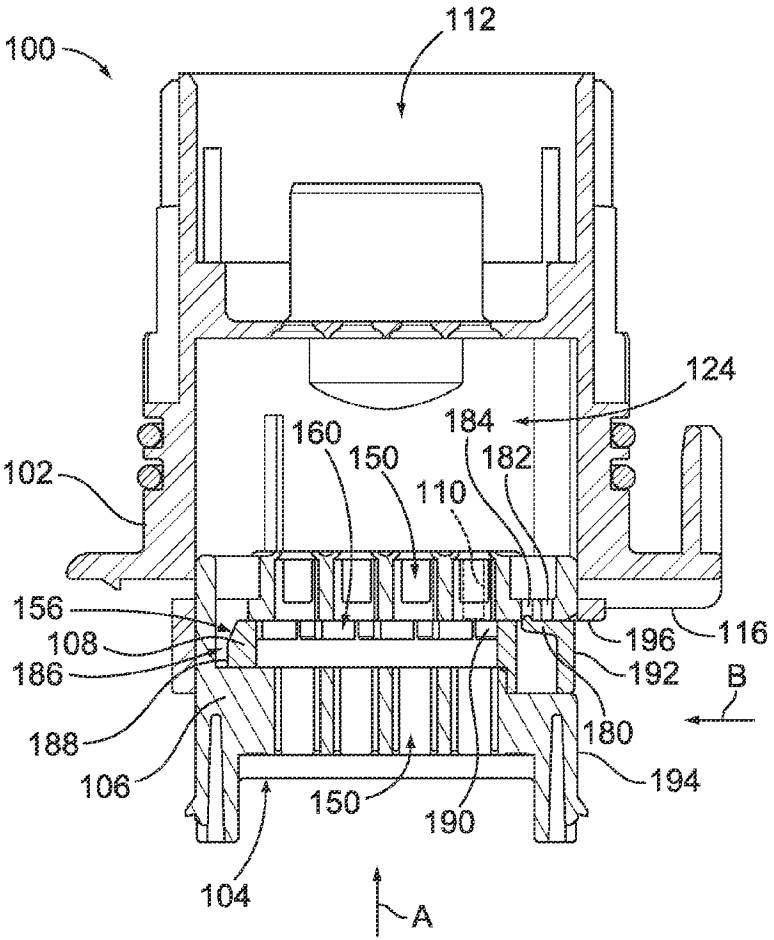
FIG. 5 is a cross-sectional view the bulkhead connector assembly showing an independent secondary lock in a blocking position.

FIG. 4 is a cross-sectional view of the bulkhead connector assembly 100 showing the insert subassembly 104 coupled to the outer housing 102 and in a terminal loading position and the ISL 108 in the clearance position. FIG. 5 is a cross-sectional view the bulkhead connector assembly 100 showing the insert subassembly 104 coupled to the outer housing 102 and in a terminal loading position and the ISL 108 in the blocking position.

In the terminal loading position, a front portion of the terminal housing 106 of the insert subassembly 104 is loaded into the wire side 124 of the internal chamber 112. A rear portion of the terminal housing 106 extends from the wire end 116. In the terminal loading position, the insert subassembly 104 is suitably positioned for loading the terminals 110 (shown in FIG. 1) into the insert subassembly 104.

As shown in FIG. 4, when in the clearance position, the ISL 108 is positioned in the slot 156 of the terminal housing 106 such that the cavities 160 of the ISL 108 are aligned with the cavities 150 of the terminal housing 106. When the ISL 108 is in the clearance position, the terminals 110 may be loaded into the terminal housing 106. After all the terminals 110 are loaded into the terminal housing 106, the ISL 108 may be moved from the clearance position to the blocking position (FIG. 5). The ISL 108 is moved to the blocking position by pressing the ISL 108 further into the slot 156, such as in the direction of arrow B.

The ISL 108 includes a positioning latch 180 engaging the terminal housing 106 to hold the ISL 108 in either the clearance position or the blocking position. In an exemplary embodiment, the terminal housing 106 includes a first opening 182 and a second opening 184. An end of the positioning latch 180 is configured to be received in either the first opening 182 or the second opening 184 to hold the radial position of the ISL 108 with respect to the terminal housing 106. When the positioning latch 180 is received in the first opening 182 (FIG. 4), the ISL 108 is in the clearance position. When the positioning latch 180 is in the second opening 184 (FIG. 5), the ISL 108 is in the blocking position. The ISL 108 is shifted radially inward into the terminal housing 106 as the ISL 108 is moved from the clearance position to the blocking position. A gap 186 is provided between an end 188 of the ISL 108 and a wall of the terminal housing 106. The gap 186 provides space for the ISL 108 to move from the clearance position to the blocking position. The gap 186 provides a means to open the ISL 108 if it were inadvertently closed into the blocking position. The insert subassembly 104 can be removed and the ISL 108 can be opened by using a screwdriver or similar tool.

In an exemplary embodiment, the ISL 108 includes interstitial walls 190 between corresponding cavities 160. In the clearance position (FIG. 4), the interstitial walls 190 are aligned with corresponding walls of the terminal housing 106 between the cavities 150. When the ISL 108 is moved to the blocking position (FIG. 5), the interstitial walls 190 are shifted to blocking positions in which the interstitial walls 190 are configured to be located directly behind portions of the terminals 110 (a representation of one terminal is shown in phantom in FIG. 5) to resist removal of the terminals 110 from the terminal housing 106. The interstitial walls 190 block the terminals 110 and operate as secondary locks for locking the terminals 110 in the terminal housing 106.

The ISL 108 includes an outer wall 192. In the clearance position (FIG. 4), the outer wall 192 is positioned radially outward of an outer wall 194 of the terminal housing 106. The outer wall 192 defines a shoulder of the insert subassembly 104 that interferes with the outer housing 102 to block loading of the insert subassembly 104 into the wire side 124 of the internal chamber 112. For example, the outer wall 192 engages a back wall 196 of the outer housing 102 stopping the insert subassembly 104 from being loaded into the wire side 124 of the internal chamber 112. In this manner, the insert subassembly 104 is restricted from loading into the outer housing 102 until the ISL 108 is moved to the blocking position.

In the blocking position (FIG. 5), the outer wall 192 is located generally flush with the outer wall 194 such that the insert subassembly 104 may be loaded into the wire side 124 of the internal chamber 112. Having the ISL 108 interfere with the outer housing 102 ensures that during assembly the ISL 108 is closed or moved to the blocking position prior to moving the insert subassembly to the locked position. Additionally, because the ISL 108 is incapable of moving from the clearance position to the blocking position when the terminals 110 are not fully loaded (e.g., when one or more of the terminals 110 is only partially loaded into the cavities 150 such that a back end of the terminals 110 are axially aligned with the ISL 108 as opposed to being properly positioned forward of the ISL 108), moving the ISL 108 to the blocking position ensures that all terminals 110 are properly loaded into the terminal housing 106. Thus, for proper assembly of the bulkhead connector assembly 100, all terminals 110 must be fully loaded into the terminal housing 106 to allow the ISL 108 to move to the blocking position. Additionally, the ISL 108 must be moved to the blocking position in order to fully load the insert subassembly 104 from the terminal loading position to a locked position, in which the insert subassembly 104 is fully loaded into the wire side 124 of the internal chamber 112.

Figure 6:
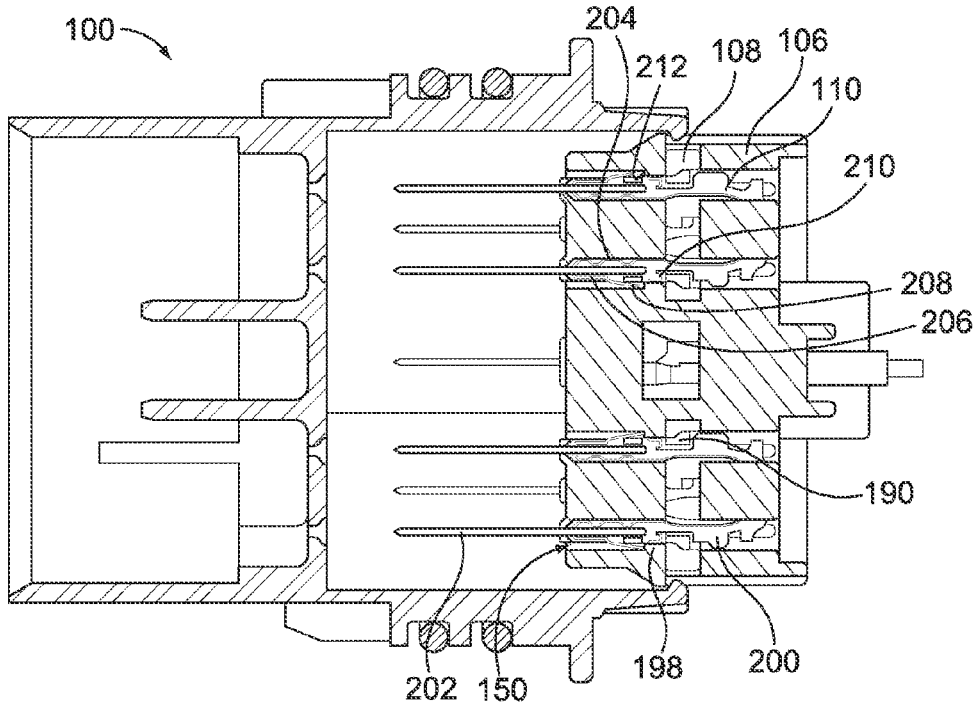
FIG. 6 is a cross-sectional view of the bulkhead connector assembly showing the terminals loaded into the terminal housing.

FIG. 6 is a cross-sectional view of the bulkhead connector assembly 100 showing the terminals 110 loaded into the terminal housing 106 with the ISL 108 in a blocking position. During assembly, the terminals 110 are loaded into the terminal housing 106 until a primary locking mechanism is reached. As shown in FIG. 6, the primary locking mechanism comprises lances 208 on the terminals 110 engaging the primary locking shoulder 198 on the terminal housing 106 to secure the terminals 110 in the terminal housing 106. The lances 208 may be referred to hereinafter as primary locking mechanisms 208. The primary locking shoulders 198 may be referred to hereinafter as primary locking mechanisms 198.

In an exemplary embodiment, the terminals 110 have box shaped front ends and wire crimps 200 provided at a back end of the terminals 110 for crimping to corresponding wires. The box shaped front ends include blades 202 extending forward therefrom. Alternatively, the front ends may define receptacle terminals, sockets or other types of mating interfaces. The box shaped front ends are defined by a plurality of walls 204, which include an outer wall 206 having a lance 208 formed therein. The walls 204 include a rear wall 210. The rear wall 210 is positioned rearward of the primary locking shoulder 198. As shown in FIG. 6, in the blocking position, the ISL 108 is positioned behind the rear wall 210.

In the blocking position, the ISL 108 blocks the rear wall 210 from being pulled rearward, thus securing the terminals 110 in the terminal housing 106. For example, the interstitial walls 190 are positioned immediately behind the rear walls 210. The primary locking shoulders 198 interact with the lances 208 to secure the terminals 110 in the terminal housing 106. The primary locking shoulders 198 engage the corresponding lances 208 to block rearward movement of the terminals 110 from the corresponding cavities 150. In the illustrated embodiment, the primary locking shoulders 198 constitute projections extending into the cavities 150. When the terminals 110 are loaded into the cavities 150, the lances 208 deflect outward when clear of the primary locking shoulders 198 to engage a forward facing surface 212 of the primary locks 198. If the primary locking shoulders 198 were to fail, such as if the lances 208 broke or became unseated from the primary locking shoulders 198, the ISL 108 operates as a secondary lock to ensure that the terminals 110 remain secured within the terminal housing 106. Other types of primary locks may be used in alternative embodiments, such as deflectable latches.

Figure 7:
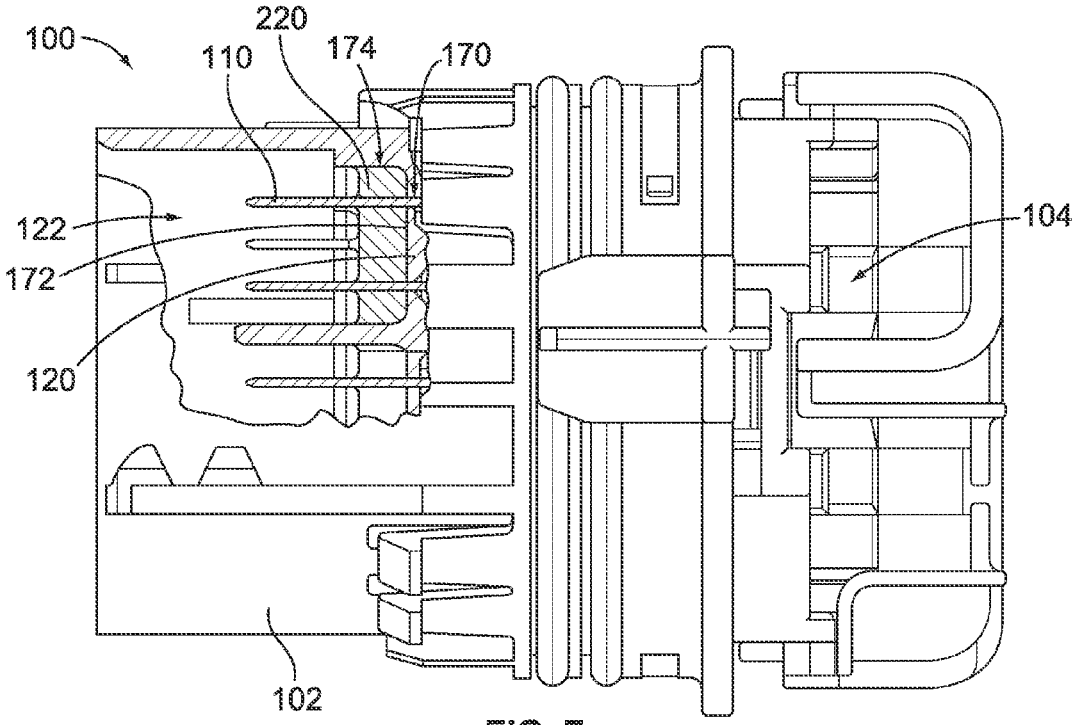
FIG. 7 is a side, partial sectional view of the bulkhead connector assembly showing the insert subassembly in a forward, locked position.

FIG. 7 is a side, partial sectional view of the bulkhead connector assembly 100 showing the insert subassembly 104 in a forward, locked position. A portion of the outer housing 102 has been removed to illustrate the terminals 110 extending through the interior wall 120 such that the terminals 110 are positioned in the mating side 122 and the wire side 124. The terminals 110 extend through corresponding cavities 170 in the interior wall 120. The terminals 110 are positioned within the mating side 122 for mating with the corresponding mating connector 118 (shown in FIG. 8). Once the insert subassembly 104 is fully loaded into the wire side 124, the insert subassembly 104 may be locked or otherwise secured in the outer housing 102, such as using latches at the rear of the outer housing 102.

Once the bulkhead connector assembly 100 is assembled, a sealant 220 is used to seal the area around the terminals 110. The sealant 220 is dispensed in the sealant well 174 against the sealant blocking floor 172. The sealant 220 surrounds the front ends blades 202 of the terminals 110. The sealant 220 is provided at the exit point of the terminals 110 from the cavities 170 in the interior wall 120. A relatively thin sealant may be used, allowing the terminals 110 to have a shorter length. Using shorter terminals allows the overall length of the connector to be decreased. Providing the sealant 220 at the sealant blocking floor 172 prevents contaminants, such as oil or other fluids from passing through the bulkhead connector assembly 100.

In an exemplary embodiment, the sealant 220 may be an epoxy. Alternatively, the sealant 220 may be a silicone or another type of sealant. Optionally, the sealant well 174 may be deep enough to accommodate a first dispensing of the sealant 220 and a second dispensing of the sealant 220. For example, after the first dispensing of the sealant 220, the bulkhead connector assembly 100 may undergo testing to ensure that the bulkhead connector assembly 100 is sufficiently sealed. If leakage is detected, a second dispensing of the sealant 220 may be performed to seal against any leakage. Optionally, the sealant 220 may be cured to harden the sealant 220 to rigidly hold the terminals 110 in place.

Figure 8:
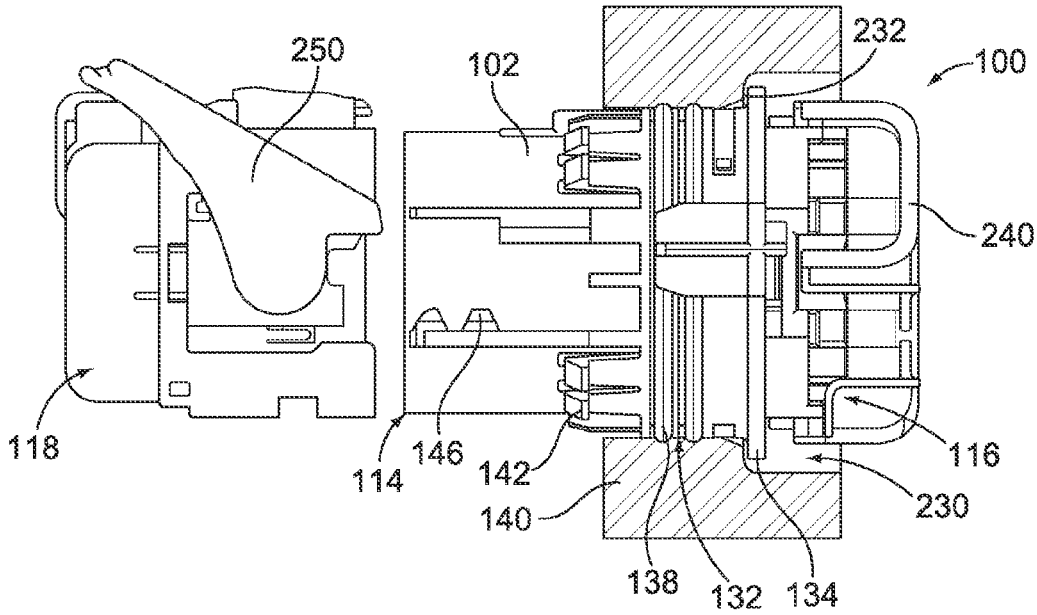
FIG. 8 illustrates the bulkhead connector assembly mounted to a panel and shows a mating connector poised for mating.

FIG. 8 illustrates the bulkhead connector assembly 100 mounted to the panel 140 and shows the mating connector 118 poised for mating with the bulkhead connector assembly 100. The panel 140 includes an opening 230 therethrough. The bulkhead connector assembly 100 is loaded into the opening 230 to create a sealed pass-through connector for electrically connecting components on one side of the panel 140 with components on the other side of the panel 140.

In an exemplary embodiment, the opening 230 includes a step 232. The bulkhead connector assembly 100 is loaded into the opening 230 until the flange section 134 engages the step 232. The mounting latches 142 are configured to engage the panel 140 to secure the bulkhead connector assembly 100 to the panel 140. When assembled, the panel 140 is held between the mounting latches 142 and the flange section 134. The sealing section 132 is aligned with the panel 140. The O-rings 138 seal against the opening 230 of the panel 140. The O-rings 138 seal the outer surfaces of the bulkhead connector assembly 100 to the panel 140 to prevent any contaminants, such as dirt, debris, oil or other fluids from passing around the bulkhead connector assembly 100.

In an exemplary embodiment, a wire dress cover 240 is coupled to the wire end 116 of the outer housing 102. The wire dress cover 240 covers the wires extending from the wire end 116. The wire dress cover 240 may direct the wires to a particular location where the wires exit the wire dress cover 240. Optionally, the wire dress cover 240 may engage the insert subassembly 104 to hold the insert subassembly 104 in the outer housing 102.

The mating connector 118 is configured to be coupled to the mating end 114 of the outer housing 102. In an exemplary embodiment, the mating connector 118 includes a lever 250 that is used as a mating assist to fully mate the mating connector 118 to the bulkhead connector assembly 100 and/or to secure the mating connector 118 to the bulkhead connector assembly 100. The lever 250 engages the mating latches 146 to secure the mating connector 118 to the bulkhead connector assembly 100. The lever 250 may be rotated or pivoted to engage the mating latches 146. Pivoting of the lever 250 may press the mating connector 118 onto the bulkhead connector assembly 100. Other types of securing features may be used in alternative embodiments to secure the mating connector 118 to the bulkhead connector assembly 100.

Figure 9:
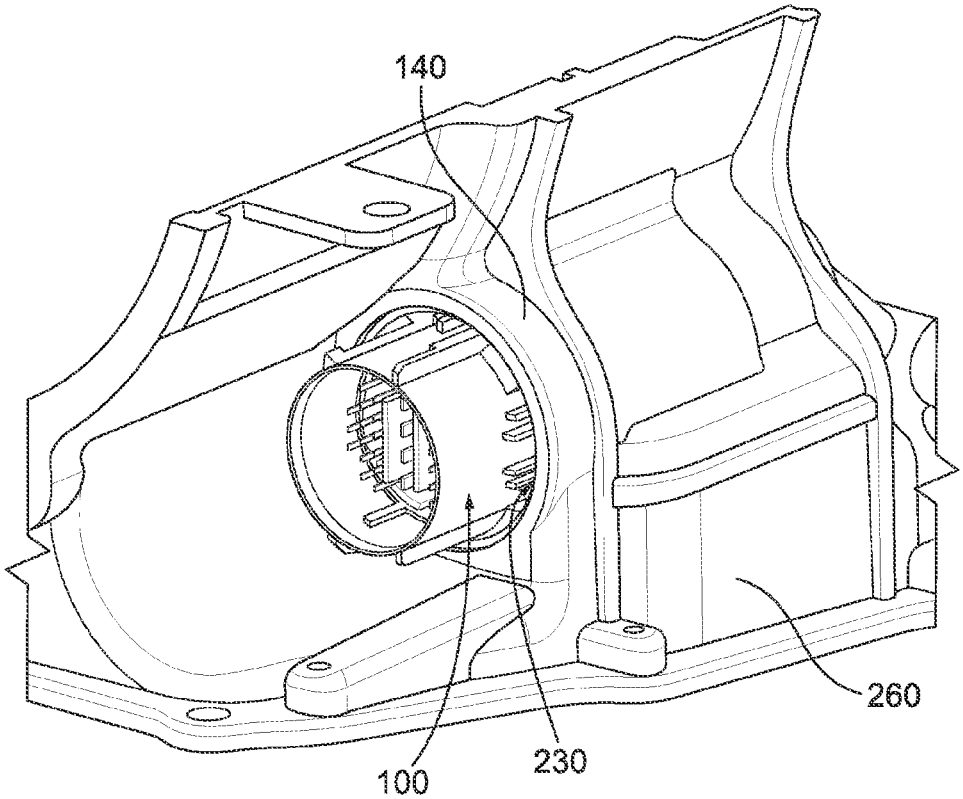
FIG. 9 illustrates the bulkhead connector assembly coupled to a transmission case.

FIG. 9 illustrates the bulkhead connector assembly 100 coupled to a transmission case 260. The transmission case 260 defines the panel 140. The bulkhead connector assembly 100 passes through the transmission case 260. The bulkhead connector assembly 100 provides a sealed pass-through connection point for electrical wires inside and/or outside of the transmission case 260. The opening 230 extends through the transmission case 260. The bulkhead connector assembly 100 seals the opening 230 to prevent contaminants from outside the transmission case 260, such as moisture, dirt and the like from entering into the transmission case 260 via the opening 230. The bulkhead connector assembly 100 seals the opening 230 to prevent contaminants insides the transmission case 260, such as transmission fluid, from exiting the transmission case 260 via the opening 230.

Figure 10:
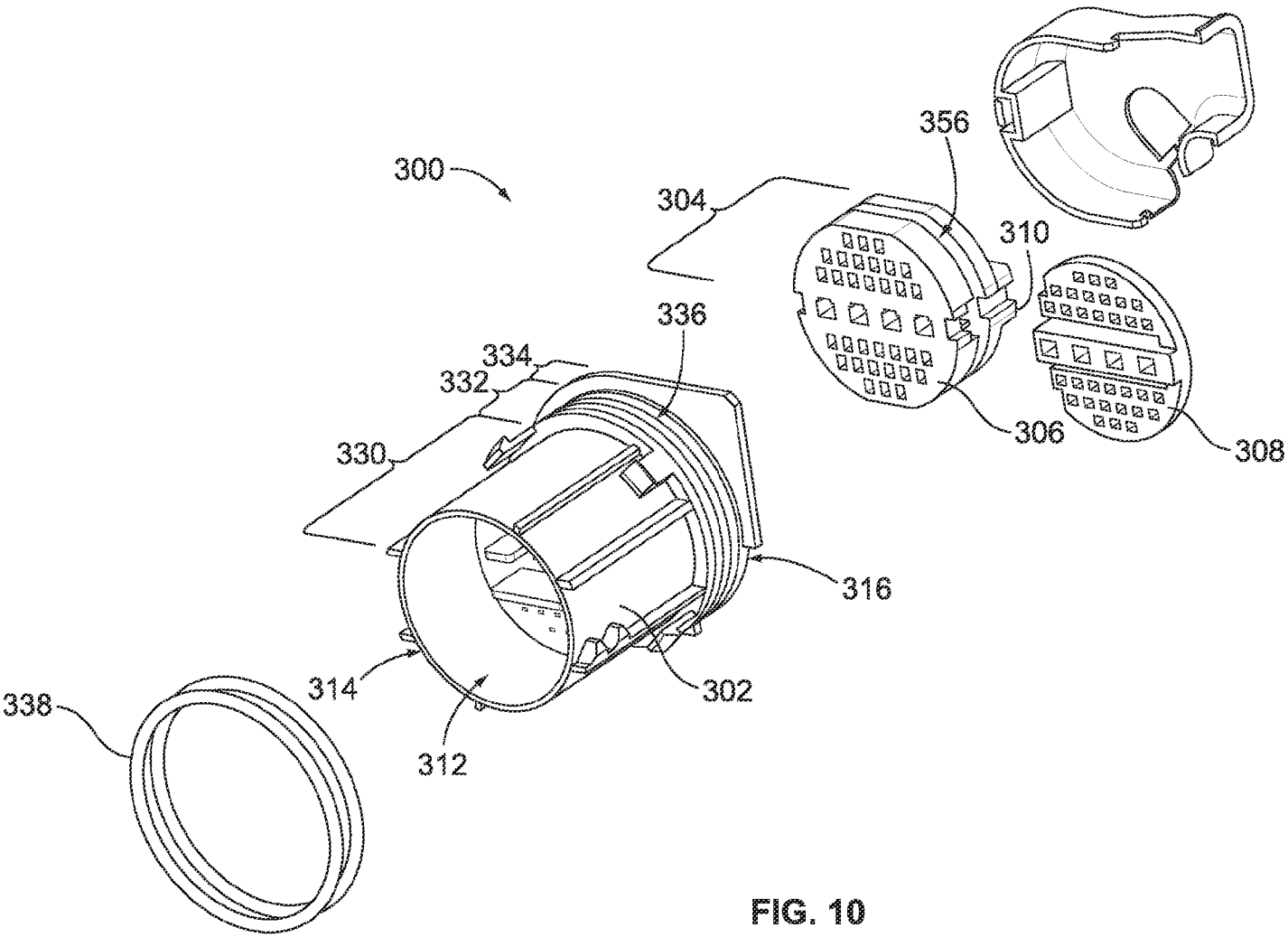
FIG. 10 is an exploded view of an exemplary embodiment of a bulkhead connector.

FIG. 10 is an exploded view of a bulkhead connector assembly 300 formed in accordance in an exemplary embodiment. The bulkhead connector assembly 300 includes an outer housing 302 and an insert subassembly 304 configured to be loaded into the outer housing 302. The insert subassembly 304 includes a terminal housing 306 and an independent secondary lock (ISL) 308. The bulkhead connector assembly 300 is similar to the bulkhead connector assembly 100 (shown in FIG. 1), however assembly of the bulkhead connector assembly 300 is different. For example, the insert subassembly 304 and terminal housing 306 are simpler and the insert subassembly 304 may be inserted into the terminal housing 306 in a different manner. The ISL 308 is actuated differently to move to the blocking position.

The outer housing 302 includes an internal chamber 312 that receives the insert subassembly 304 and terminals (not shown), which may be similar to the terminals 110 (shown in FIG. 1). The outer housing 302 has a mating end 314 and a wire end 316. The mating end 314 is configured to be mated with a mating connector, such as the mating connector 118 (shown in FIG. 9).

The outer housing 302 includes a mating section 330, a sealing section 332 and a flange section 334. The outer housing 302 includes one or more grooves 336 in the sealing section 332. O-rings 338 are configured to be set into corresponding grooves 336 to seal the outer surface of the bulkhead connector assembly 300 with a panel to prevent any contaminants from passing around the bulkhead connector assembly 300.

The terminal housing 306 is sized and shaped to fit in the internal chamber 312. The terminal housing 306 includes a slot 356 that receives the ISL 308. In an exemplary embodiment, the ISL 308 is radially inserted into the terminal housing 306 by way of the slot 356. The ISL 308 may be variably positionable within the terminal housing 306. For example, the ISL 308 may be positionable at a clearance position and at a blocking position. The ISL 308 allows the terminals 110 to be loaded into the terminal housing 306 in the clearance position. The ISL 308 is configured to block the terminals 110 from removal from the insert subassembly 304 in the blocking position. The ISL 308 operates as a secondary lock to block the terminals 110 from removal from the terminal housing 306.

During assembly, the ISL 308 is loaded into the terminal housing 306. The insert subassembly 304 is loaded into the outer housing 302. The terminals may be loaded into the insert subassembly 304 either before or after the insert subassembly 304 is loaded into the outer housing 302. The ISL 308 is movable between the clearance and blocking positions independent of the location of the insert subassembly 304. For example, the ISL 308 may be movable to the blocking position after the ISL 308 is loaded into the outer housing 302 to the final or locked position. A tool may be used and placed in an actuation area 310 of the terminal housing 306 to actuate the ISL 308 to the blocking position.

The bulkhead connector assembly 300 is less complex to assemble, providing more flexibility in assembly, however the bulkhead connector assembly 300 does not include the safety features of the bulkhead connector assembly 100, such as restricting loading of the insert subassembly into the outer housing to situations in which the ISL is properly positioned in the blocking position, ensuring that the secondary lock is in use and ensuring that the terminals are fully loaded.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A bulkhead connector assembly comprising:

an outer housing having an internal chamber, the outer housing having a sealing section configured to seal an exterior of the outer housing within an opening;

a terminal housing configured to hold a plurality of terminals, the terminal housing being received in the internal chamber, the terminal housing having primary locking mechanisms configured to secure the terminals in the terminal housing; and an independent secondary lock (ISL) separately provided from, and coupled to, the terminal housing, the ISL being configured to secure the terminals in the terminal housing, wherein the ISL is moveable with respect to the terminal housing between a clearance position and a blocking position, the ISL allowing the terminals to be loaded into the terminal housing in the clearance position, the ISL blocking the terminals from removal from the terminal housing in the blocking position, and wherein the ISL must be in the blocking position before the terminal housing is capable of being loaded to a final locked position in the internal chamber.

2. The bulkhead connector assembly of claim 1, wherein the terminal housing and the ISL together form an insert subassembly loaded into the internal chamber as a unit.

3. The bulkhead connector assembly of claim 1, wherein the terminals must be fully loaded into the terminal housing to a locked position, in which the primary locking mechanism secure the terminals in the terminal housing, before the ISL is capable of being moved to the blocking position.

4. The bulkhead connector assembly of claim 1, wherein the terminal housing and the ISL are unsealed with respect to the outer housing.

5. The bulkhead connector assembly of claim 1, wherein the terminal housing includes a front surface and a rear surface, the terminal housing including a slot positioned axially between the front surface and the rear surface, the ISL being radially inserted into the slot.

6. The bulkhead connector assembly of claim 1, wherein the outer housing includes an interior wall separating the internal chamber into a mating side and a wire side, the interior wall having a plurality of cavities therethrough configured to receive the terminals such that the terminals are located in both the mating side and wire side of the internal chamber, the interior wall defining a sealant blocking floor for the mating side for the internal chamber, a sealant being applied at the sealant blocking floor, the sealant being configured to seal the terminals at the cavities.

7. A bulkhead connector assembly comprising:

an outer housing having an internal chamber, the outer housing having a mating end and a wire end, the outer housing having a sealing section between the mating and wire ends, the sealing section configured to seal an exterior of the outer housing within an opening; and an insert subassembly configured to be received in the internal chamber, the insert subassembly comprising a terminal housing and an independent secondary lock (ISL) separately provided from, and coupled to, the terminal housing;

the terminal housing being configured to hold a plurality of terminals, the terminal housing having primary locking mechanisms configured to secure the terminals in the terminal housing;

the ISL being configured to independently secure the terminals in the terminal housing, the ISL being movable with respect to the terminal housing between a clearance position and a blocking position, the ISL allowing the terminals to be loaded into the terminal housing in the clearance position, the ISL being configured to block the terminals from removal from the insert subassembly in the blocking position;

wherein the insert subassembly is able to be coupled to the outer housing in a terminal loading position and a locked position, the insert subassembly being loaded into the wire end of the outer housing to the terminal loading position and being further loaded into the internal chamber to the locked position only after the ISL is moved to the blocking position.

8. The bulkhead connector assembly of claim 7, wherein the terminals must be fully loaded into the terminal housing to a locked position, in which the primary locking mechanisms secure the terminals in the terminal housing, before the ISL is capable of being moved to the blocking position.

9. The bulkhead connector assembly of claim 7, wherein the terminal housing and the ISL are unsealed with respect to the outer housing.

10. The bulkhead connector assembly of claim 7, wherein the terminal housing includes a front surface and a rear surface, the terminal housing including a slot positioned axially between the front surface and the rear surface, the ISL being radially inserted into the slot.

11. The bulkhead connector assembly of claim 7, wherein the outer housing includes an interior wall separating the internal chamber into a mating side and a wire side, the interior wall having a plurality of cavities therethrough configured to receive the terminals such that the terminals are located in both the mating side and wire side of the internal chamber, the interior wall defining a sealant blocking floor for the mating side for the internal chamber, a sealant being applied at the sealant blocking floor, the sealant being configured to seal the terminals at the cavities.

12. A bulkhead connector assembly comprising:

an outer housing having an internal chamber, the outer housing having an interior wall separating the internal chamber into a mating side and a wire side, the interior wall having a plurality of cavities therethrough configured to receive terminals therethrough such that the terminals are located in both the mating side and wire side of the internal chamber, the interior wall defining a sealant blocking floor for the mating side of the internal chamber, the outer housing having a sealing section configured to seal an exterior of the outer housing within an opening;

a terminal housing configured to hold a plurality of terminals, the terminal housing being received in the internal chamber, the terminal housing having primary locking mechanisms configured to secure the terminals in the terminal housing;

an independent secondary lock (ISL) separately provided from, and coupled to, the terminal housing, the ISL being configured to secure the terminals in the terminal housing; and a sealant at the sealant blocking floor configured to seal the terminals at the cavities.

13. The bulkhead connector assembly of claim 12, wherein the terminal housing and the ISL together form an insert subassembly loaded into the internal chamber as a unit.

14. The bulkhead connector assembly of claim 12, wherein the ISL is moveable with respect to the terminal housing between a clearance position and a blocking position, the ISL allowing the terminals to be loaded into the terminal housing in the clearance position, the ISL being configured to block the terminals from removal from the terminal housing in the blocking position.

15. The bulkhead connector assembly of claim 14, wherein the ISL must be in the blocking position before the terminal housing is capable of being loaded to a final, locked position in the internal chamber.

16. The bulkhead connector assembly of claim 14, wherein the terminals must be fully loaded into the terminal housing to a locked position, in which the primary locking mechanisms secure the terminals in the terminal housing, before the ISL is capable of being moved to the blocking position.

17. The bulkhead connector assembly of claim 12, wherein the terminal housing and the ISL are unsealed with respect to the outer housing.

18. The bulkhead connector assembly of claim 12, wherein the terminal housing includes a front surface and a rear surface, the terminal housing including a slot positioned axially between the front surface and the rear surface, the ISL being radially inserted into the slot.

* * * * *